US007142071B2

(12) United States Patent
Coleman

(10) Patent No.: US 7,142,071 B2
(45) Date of Patent: Nov. 28, 2006

(54) BROADBAND HIGH-FREQUENCY SLIP-RING SYSTEM

(75) Inventor: Donnie S. Coleman, Dublin, VA (US)

(73) Assignee: Moog Inc., East Aurora, NY (US)

( * ) Notice: Subject to any disclaimer, the term of this patent is extended or adjusted under 35 U.S.C. 154(b) by 0 days.

(21) Appl. No.: 11/192,910

(22) Filed: Jul. 29, 2005

(65) Prior Publication Data

US 2005/0258915 A1 Nov. 24, 2005

Related U.S. Application Data

(63) Continuation-in-part of application No. 10/778,501, filed on Feb. 16, 2004, now Pat. No. 6,956,445.

(60) Provisional application No. 60/448,292, filed on Feb. 19, 2003.

(51) Int. Cl.
*H01P 1/06* (2006.01)

(52) U.S. Cl. ..... 333/24 R; 333/261

(58) Field of Classification Search ..... 333/24 R, 333/32, 261

See application file for complete search history.

(56) References Cited

U.S. PATENT DOCUMENTS

| | | | | |
|---|---|---|---|---|
| 3,382,387 | A | 5/1968 | Marshall | 310/219 |
| 5,805,115 | A | 9/1998 | Pellerin et al. | 343/763 |
| 6,985,046 | B1 * | 1/2006 | Schilling | 333/24 R |

* cited by examiner

*Primary Examiner*—Dean Takaoka
(74) *Attorney, Agent, or Firm*—Phillips Lytle LLP

(57) ABSTRACT

A velocity compensated contacting ring system includes a first dielectric material, a plurality of concentric spaced conductive rings and a first ground plane. The first dielectric material includes a first side and a second side. The plurality of concentric spaced conductive rings are located on the first side of the first dielectric material. The conductive rings include an inner ring and an outer ring. The first ground plane is located on the second side of the first dielectric material. A width of the inner ring is greater than a width of the outer ring and the widths of the inner and outer rings are selected to substantially equalize electrical lengths of the inner and outer rings.

16 Claims, 9 Drawing Sheets

BROADBAND HIGH-FREQUENCY SLIP-RING SYSTEM

This application is a continuation-in-part of U.S. patent application Ser. No. 10/778,501, entitled "BROADBAND HIGH-FREQUENCY SLIP RING SYSTEM," by Applicant Donnie S. Coleman, filed Feb. 16, 2004, now U.S. Pat. No. 6,956,445 which claims the benefit of the filing date of U.S. Provisional Patent Application Ser. No. 60/448,292 entitled, "BROADBAND HIGH-FREQUENCY SLIP RING SYSTEM," by Donnie S. Coleman, filed Feb. 19, 2003, the entire disclosures of which are hereby incorporated by reference.

BACKGROUND OF THE INVENTION

The present invention is generally directed to a contact-type slip-ring system that is utilized to transfer signals from a stationary reference frame to a moving reference frame and, more specifically, to a contact-type slip-ring system that is suitable for high data rate communication.

Contact-type slip-rings have been widely used to transmit signals between two frames that move in rotational relation to each other. Prior art slip-rings of this nature have utilized precious alloy conductive probes to make contact with a rotating ring system. These probes have traditionally been constructed using round-wire, composite materials, button contacts or multi-filament conductive fiber brushes. The corresponding concentric contact rings of the slip-ring are typically shaped to provide a cross-section shape appropriate for the sliding contact. Typical ring shapes have included V-grooves, U-grooves and flat rings. Similar schemes have been used with systems that exhibit translational motion rather than rotary motion.

When transmitting high-frequency signals through slip-rings, a major limiting factor to the maximum transmission rate is distortion of the waveforms due to reflections from impedance discontinuities. Impedance discontinuities can occur throughout the slip-ring wherever different forms of transmission lines interconnect and have different surge impedances. Significant impedance mismatches often occur where transmission lines interconnect a slip-ring to an external interface, at the brush contact structures and where the transmission lines connect those brush contact structures to their external interfaces. Severe distortion to high-frequency signals can occur from either of those impedance mismatched transitions of the transmission lines. Further, severe distortion can also occur due to phase errors from multiple parallel brush connections.

The loss of energy through slip-rings increases with frequency due to a variety of effects, such as multiple reflections from impedance mismatches, circuit resonance, distributed inductance and capacitance, dielectric losses and skin effect. High-frequency analog and digital communications across rotary interfaces have also been achieved or proposed by other techniques, such as fiber optic interfaces, capacitive coupling, inductive coupling and direct transmission of electromagnetic radiation across an intervening space. However, systems employing these techniques tend to be relatively expensive.

What is needed is a slip-ring system that addresses the above-referenced problems, while providing a readily producible, economical slip-ring system.

SUMMARY OF THE INVENTION

According to one embodiment of the present invention, a contacting ring system includes a first dielectric material, a plurality of concentric spaced conductive rings and a first ground plane. The first dielectric material includes a first side and a second side. The plurality of concentric spaced conductive rings are located on the first side of the first dielectric material. The conductive rings include an inner ring and an outer ring. The first ground plane is located on the second side of the first dielectric material. A width of the inner ring is greater than a width of the outer ring and the widths of the inner and outer rings are selected to substantially equalize electrical lengths of the inner and outer rings.

According to another aspect of the present invention, grooves are formed in the first dielectric material on at least one side of the outer ring to cause an increase in a signal propagation velocity of the outer ring. According to a different aspect of the present invention, a second ground plane is formed in the first dielectric material between the inner ring and the first ground plane. The second ground plane, when implemented, cause a decrease in a signal propagation velocity of the inner ring. According to another aspect of the present invention, the thicknesses of the inner and outer rings are different. According to still another aspect of the present invention, the surface finishes of the inner and outer rings are different. According to another embodiment of the present invention, the inner and outer rings provide a differential pair of a transmission line. According to a different aspect of the present invention, the inner and outer rings provide a non-differential transmission line. According to this aspect of the present invention, the non-differential transmission line may be a coplanar waveguide.

According to yet another embodiment of the present invention, a plurality of terminators are located to reduce reflections attributable to impedance discontinuities. According to this aspect of the present invention, the terminators are at least one of surface mount components, embedded passive components or components created using strip-line techniques. The terminators may be positioned within vias. The embedded passive components may be thin-film components.

These and other features, advantages and objects of the present invention will be further understood and appreciated by those skilled in the art by reference to the following specification, claims and appended drawings.

DETAILED DESCRIPTION OF PREFERRED EMBODIMENTS

Figure 1:
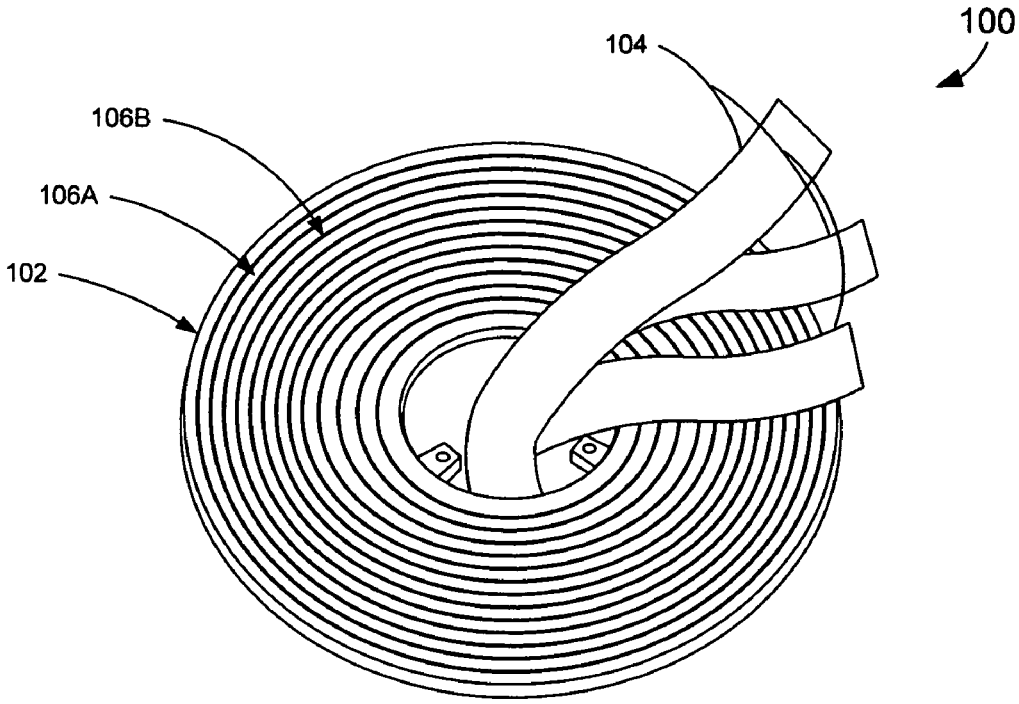
FIG. 1 is a perspective view of a high-frequency (HF) printed circuit board (PCB) slip-ring platter including flexible circuit transmission lines that provide outside connection to ring structures of the slip-ring platter.

As is disclosed herein, a broadband contacting slip-ring system is designed for high-speed data transmission over a frequency range from DC to several GHz. Embodiments of the present invention employ a conductive printed circuit board (PCB) slip-ring platter that utilizes high-frequency materials and techniques and an associated transmission line that interconnects conductive rings of the PCB slip-ring platter to an external interface. Embodiments of the present invention may also include a contacting probe system that also utilizes PCB construction and high-frequency techniques to minimize degradation of signals attributable to high-frequency and surge impedance effects. The contacting probe system includes a transmission line that interconnects the probes of the contacting probe system to an external interface, again utilizing various techniques to minimize degradation of signals due to high-frequency and surge impedance effects. Various embodiments of the present invention address the difficulty of controlling factors that constrain high-frequency performance of a slip-ring. Specifically, embodiments of the present invention control the impedance of transmission line structures and address other concerns related to high-frequency reflection and losses.

One embodiment of the present invention addresses key problem areas related to high-frequency reflections and losses associated with the sliding electrical contact system of slip-rings. Various embodiments of the present invention utilize a concentric ring system of flat conductive rings and flat interdigitated precious metal electrical contacts. Both structures are fabricated utilizing PCB materials and may implement microstrip and strip-line transmission lines and variations thereof.

Flat Form Brush Contact System

In general, utilizing a flat form brush contact provides significant benefits related to high-frequency slip-rings, as compared to round wire contacts and other contact forms. These benefits include: reduced skin effect, as larger surface areas tend to reduce high-frequency losses; lower inductance, as a flat cross-section tends to reduce inductance and high-frequency loss; lower surge impedance, which is more compatible with slip-ring differential impedances; higher compliance (low spring rate), which is tolerant of axial run-out of a slip-ring platter; compatibility with surface mount PCB technology; and high lateral rigidity, which allows brushes to run accurately on a flat ring system.

High lateral rigidity is generally desirable to create a slip-ring contact system that operates successfully with a flat ring system. Such a flat ring system can readily utilize PCB technology in the creation of the ring system. In general, PCB technology is capable of providing a well controlled impedance characteristic that can be of significantly higher impedance value than allowed by prior art techniques. This higher impedance makes it possible to match the characteristic impedance of common transmission lines, again addressing one of the problems associated with high-frequency data transmission.

Interdigitated contacts, i.e., bifurcated contacts, trifurcated contacts or contacts otherwise divided into multiple parallel finger contacts, have other significant advantages germane to slip-ring operation. Parallel contact points are a traditional feature of slip-rings from the design standpoint of providing acceptably low dynamic resistance. With conventional slip-rings, dynamic noise can have a significant inductive component from the wiring necessary to implement multiple parallel contacts. Flat brush contacts offer multiple low inductance contact points operating in parallel and provide a significant improvement in dynamic noise performance.

Figure 2:
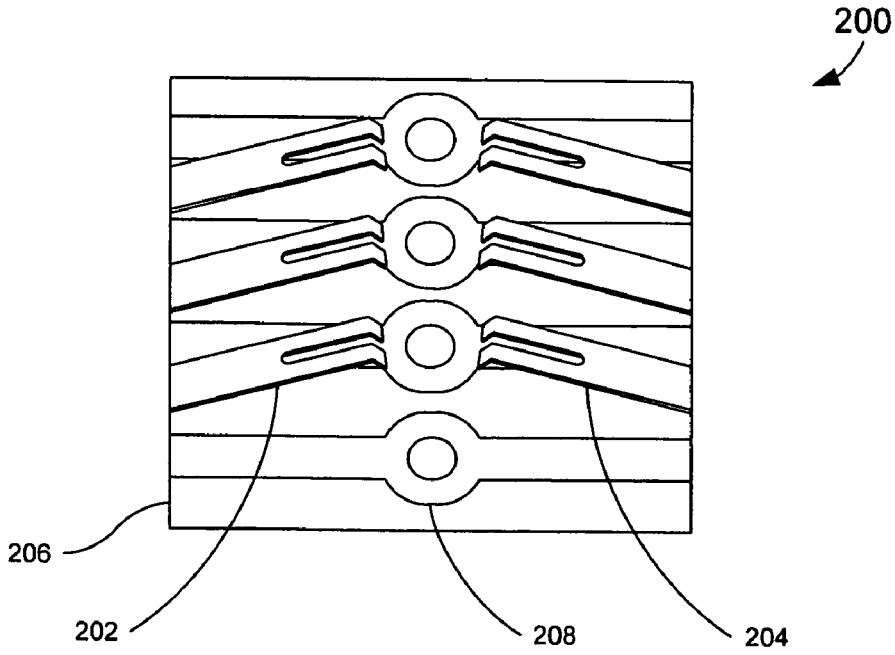
FIG. 2 is a partial perspective view of a plurality of bifurcated flat brush contacts and an associated PCB.
Figure 3:
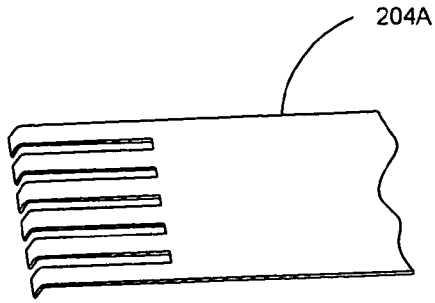
FIG. 3 is a partial view of an exemplary six-finger interdigitated flat brush contact.
Figure 4:
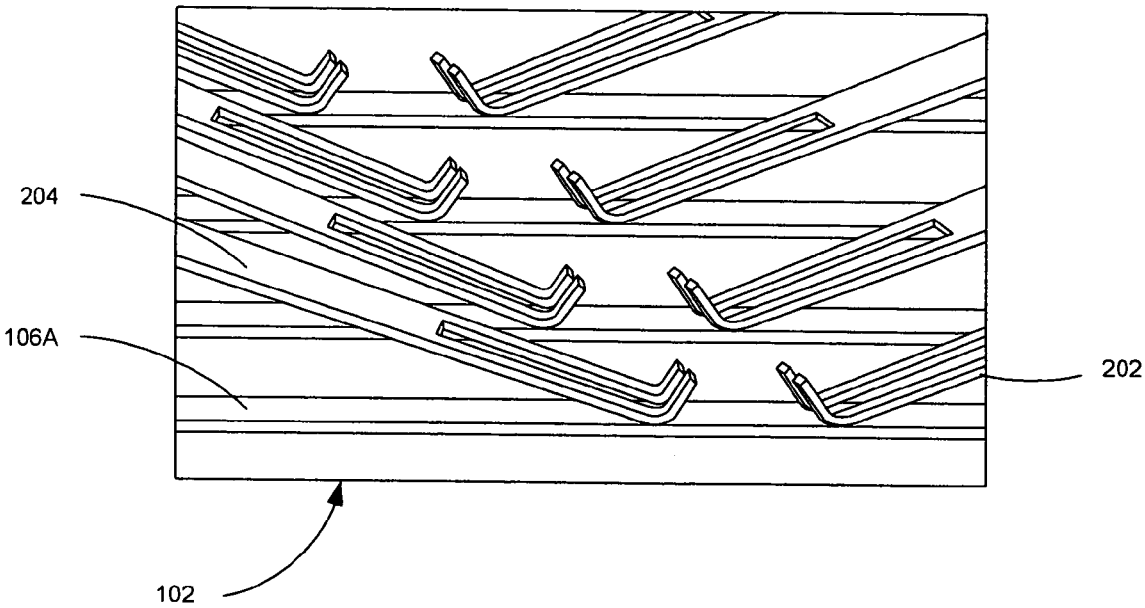
FIG. 4 is a perspective view of ends of a plurality of bifurcated flat brush contacts that are in contact with conductive rings of a PCB slip-ring platter.
Figure 5:
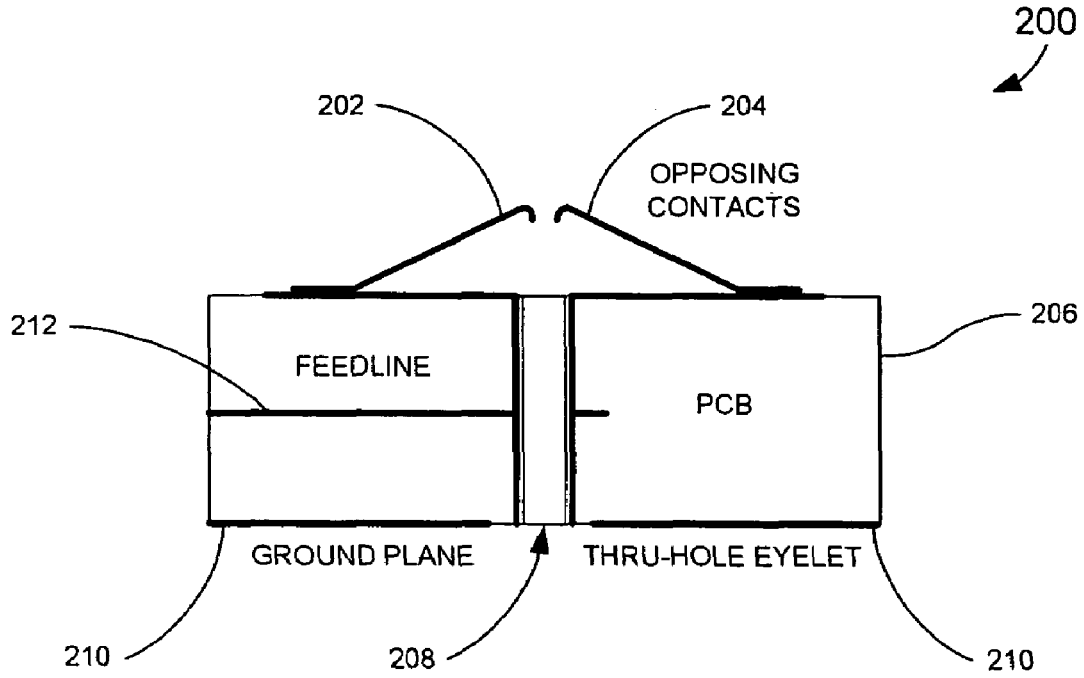
FIG. 5 is a partial cross-sectional view of a central eyelet feedpoint of the bifurcated flat brush contacts of FIG. 2.
Figure 6:
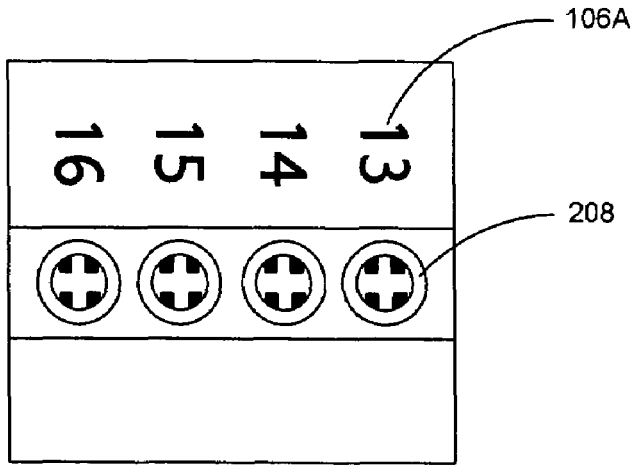
FIG. 6 is a partial top view of a slip-ring system showing the alignment of a plurality of bifurcated flat brush contacts, through central eyelet feedpoints, with conductive rings of a PCB slip-ring platter.

As is shown in FIGS. 2 and 5, a particular implementation of multiple flat brush contacts 200 is a pair of such brushes 202 and 204 mounted opposing each other on a PCB 206 and fed through a central eyelet or via 208. Aside from the advantages of multiple brushes for increased current capacity and reduced dynamic resistance, this implementation also has high-frequency performance benefits. The central eyelet 208 assures equal length transmission lines and in-phase signals to both brushes 202 and 204, as well as surge impedances favorable to impedance matching of slip-rings and low loss. The location of the opposing contact brush tips in close proximity helps to reduce phasing errors from the slip-ring. With reference to FIGS. 1 and 6, the central via 208 also allows for visual alignment verification of the contact brushes 202 and 204 to a ring, e.g., ring 106A, which is a highly desirable feature that simplifies slip-ring assembly.

Figure 7A:
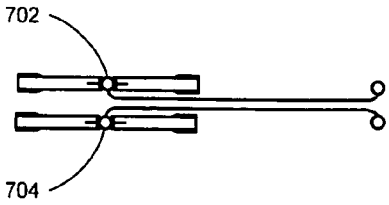
FIG. 7A shows an electrical diagram of a differential brush contact system.
Figure 7B:
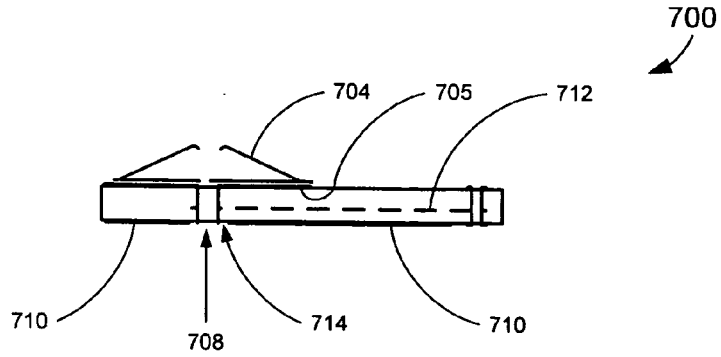
FIG. 7B shows a cross-sectional view of a PCB implementing the differential brush contact system of FIG. 7A.

As is depicted in FIGS. 7A–7B, at high data rates and high frequencies, center-fed brush structures 702 and 704 can be optimally used in differential transmission lines. The transmission line geometry shown is typically implemented with a multi-layer PCB 700. The flat brush contacts 702 and 704 are surface-mounted to a microstrip structure 705 over a ground plane 710. The connection between the brushes 702 and 704 and the external input terminals takes the form of an embedded microstrip 712. The size and spacing of the brush microstrips 705 and the embedded microstrip transmission line 712 that feeds them is dictated by the necessity to match the impedance of the external transmission line and associated slip-ring. The via holes for connection of external transmission lines and associated central feed via 708 completely penetrate the PCB 700 and have relief areas 714 in the ground plane 710 for electrical isolation. Two PCBs can be bonded back-to-back to feed two slip-rings, with the vias penetrating both boards in an analogous fashion.

Figure 8:
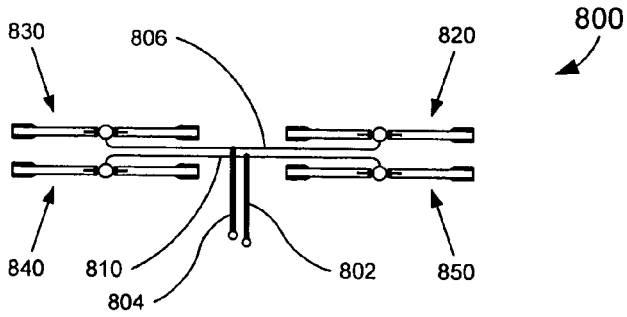
FIG. 8 is an electrical diagram of a parallel feed differential brush contact system.

As is illustrated in FIG. 8, multiple brush structures can be implemented utilizing PCB techniques, as described above, to create transmission line sections of the correct impedance. For example, assuming the use of 50 Ohm cabling, the "crossfeed" transmission lines 802 and 804 are designed for a differential impedance of 50 Ohms, matching the external feedline. The parallel connections to the brush structures are by means of equal length transmission lines 806 and 810. Such transmission lines that provide in-phase signals to the brush structures are referred to in this document as "zero-degree phasing lines," in keeping with a similar expression used for phased antenna arrays. The impedance of these "zero-degree phasing lines" is twice that of the "crossfeed lines," or 100 Ohms. The differential impedance of the slip-ring utilized with a contact structure 800, as illustrated in FIG. 8, is then two times that of the phasing lines 806 and 810, or 200 Ohms. A general solution to parallel feed of N contact structures establishes the differential impedance of the phasing lines as N times the input impedance.

Figure 9:
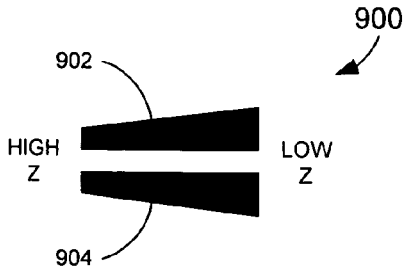
FIG. 9 is a diagram of a tapered parallel differential transmission line.

In those instances in which the impedances are not convenient or achievable values, the use of a gradated (i.e., changing in a continuous, albeit almost imperceptible, fashion) impedance transmission line 900 can be used as a matching section between dissimilar impedances. With reference to FIG. 9, a diagram illustrates a gradated impedance matching section, which shows a tapered parallel differential transmission line 900. Tapering the traces 902 and 904 is one method of continuously varying the impedance, which minimizes the magnitude of the reflections that would otherwise result from abrupt impedance discontinuities.

Figure 10:
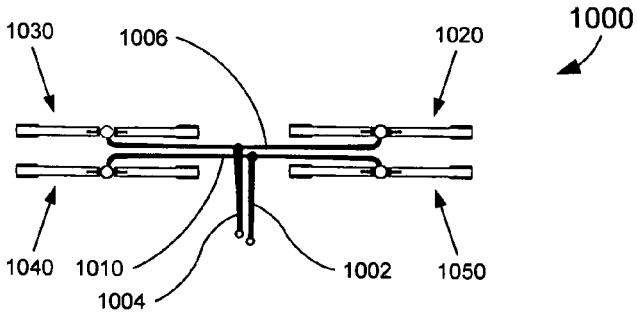
FIG. 10 is an electrical diagram of a pair of differential gradated transmission lines.

FIG. 10 illustrates the use of gradated impedance transmission lines as a solution for ameliorating the effects of dissimilar impedance values. In this example, the differential impedance of the slip-ring associated with the contact system is too low to conveniently match the phasing lines, as described in conjunction with FIG. 8. The taper of the crossfeed lines 1002 and 1004 allows the impedance of the transmission line to be gradually reduced to an intermediate value of impedance between that of the rings of the slip-ring platter and the external transmission line. The taper of the zero-degree phasing lines 1006 and 1010 allows the impedance to be gradually increased from that of the slip-ring to match the intermediate value described above. The net effect of utilizing gradated impedance matching sections is to reduce the magnitude of the reflections from what would otherwise be substantial impedance mismatches. The minimizing of impedance discontinuities is desirable from the standpoint of preserving signal integrity of high-speed data waveforms.

Figure 11:
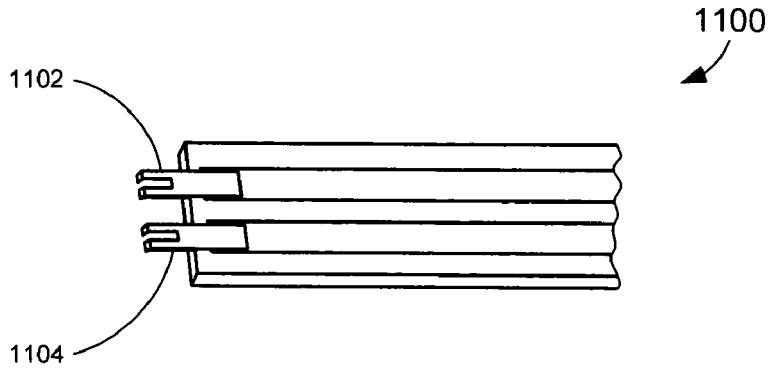
FIG. 11 is a perspective view of a portion of a microstrip contact.
Figure 12:
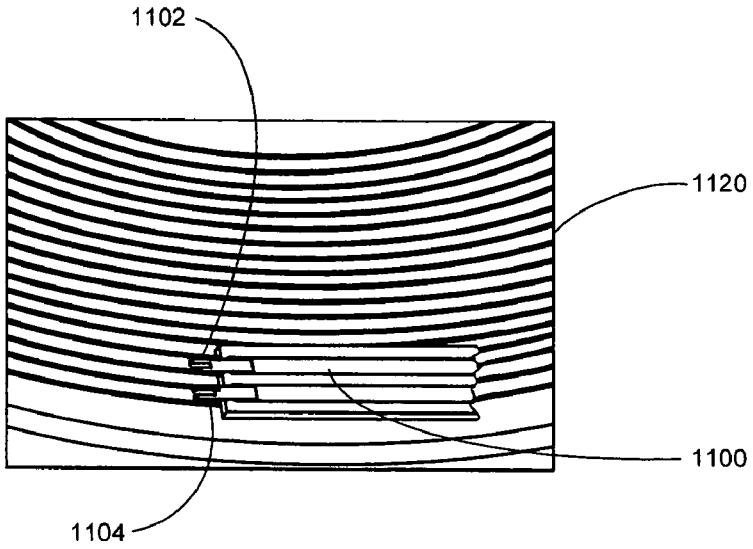
FIG. 12 is a perspective view of the microstrip contact of FIG. 11 in contact with a pair of concentric rings of a PCB slip-ring platter.

Another technique for constructing a contact system for slip-rings functioning beyond one GHz is shown in FIG. 11. This technique utilizes a microstrip contact 1100 to preserve the transmission line characteristics to within a few millimeters of the slip-ring before transitioning to the contacts 1102 and 1104. The microstrip contact 1100 acts as a cantilever spring to provide correct brush force, as well as providing an impedance controlled transmission line. Thus, the microstrip contact 1100 acts simultaneously as a transmission line, a spring and a brush contact, with performance advantages beyond one GHz. The embodiment of FIG. 12, which depicts the contact 1100 of FIG. 11 in conjunction with a slip-ring platter 1120, functions to provide a single high-speed differential data channel of a broadband slip-ring.

Flat-Form PCB Broadband Slip-ring Platter

Systems that implement a broadband slip-ring platter with a flat interdigitated brush contact system are typically implemented utilizing multi-layer PCB techniques, although other techniques are also possible. High-frequency performance is enhanced by the use of low dielectric constant substrates and controlled impedance transmission lines utilizing microstrip, strip-line, coplanar waveguide and similar techniques. Further, the use of balanced differential transmission lines is an important tool from the standpoint of controlling electromagnetic emission and susceptibility, as well as common-mode interference. Microstrip, strip-line and other microwave construction techniques also promote accurate impedance control of the transmission line structures, a factor vital to the wide bandwidths necessary for high-frequency and digital signaling. A specific implementation depends primarily upon the desired impedance and bandwidth requirements.

Figure 13A:
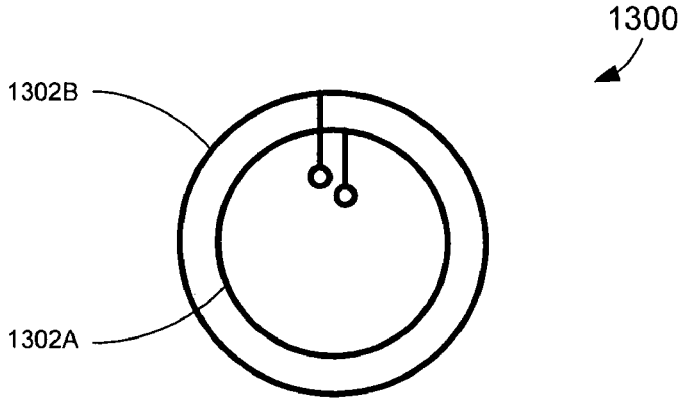
FIG. 13A is an electrical diagram of a PCB slip-ring platter that implements differential transmission lines.
Figure 13B:
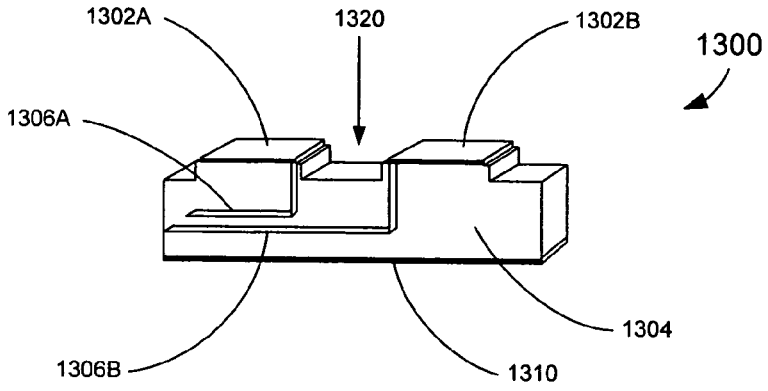
FIG. 13B is a partial cross-sectional view of a three layer PCB utilized in the construction of the PCB slip-ring platter of FIG. 13A.

FIGS. 13A–13B show an electrical diagram and a partial cross-section, respectively, of a slip-ring platter 1300 utilizing microstrip construction, with conductive rings 1302A and 1302B etched on one side of a PCB dielectric material 1304, with a ground plane 1310 on the opposite side. The PCB material 1304 is chosen for the desired dielectric constant that is appropriate for the desired impedance of the slip-ring platter 1300. Connections between the conductive rings 1302A and 1302B and the external transmission lines are accomplished by embedded microstrips 1306A and 1306B, respectively. Microstrips 1306A and 1306B are typically routed to a via or surface pad for attachment to wiring or other transmission line. Connections between the feedlines 1306A and 1306B and the rings 1302A and 1302B are provided by vias that run between the two layers. The structure shown is typically a three-layer structure, or five to six layers if constructed as a double-sided slip-ring platter. The ground plane 1310 can be a solid or a mesh construction depending upon whether the ground plane is to act as an additional impedance variable and/or to control board distortion.

Negative barrier 1320, i.e., a groove machined between the rings, accomplishes some of the functions of a more traditional barrier, such as increasing the surface creep distance for dielectric isolation and to providing physical protection against larger pieces of conductive debris. The negative barrier 1320 used in a high-frequency slip-ring platter also has the feature of decreasing the effective dielectric constant of the ring system by replacing solid dielectric with air. The electrical advantage of this feature is that it allows higher impedance slip-ring platters to be constructed than would otherwise be practical for a given dielectric. Furthermore, the negative barrier 1320 may also be implemented to provide velocity compensation, as is further described below.

The rings 1302A and 1302B can be fed either single-ended and referenced to the ground plane 1310 or differentially between adjacent rings. As is described above, the feedlines 1306A and 1306B can be either constant width traces sized appropriately for the desired impedance or can be gradated impedance transmission lines to aid in matching dissimilar impedances.

The PCB slip-ring construction, described above, provides good high-frequency performance to frequencies of several hundred MHz, depending upon the physical size of the slip-ring platter and the chosen materials. The largest constraint to the upper frequency limit of such a slip-ring platter is imposed by resonance effects as the transmission lines become a significant fraction of the wavelength of the desired signal. Typically, reasonable performance can be expected up to a ring circumference of about one-tenth the electrical wavelength of the signal with reasonable values of insertion loss and standing wave ratio.

Figure 14:
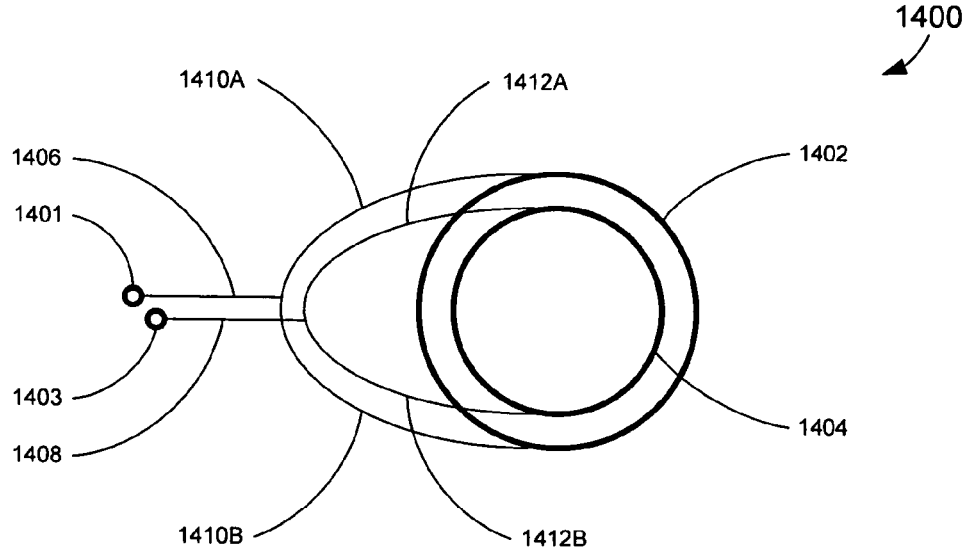
FIG. 14 is an electrical diagram of a PCB slip-ring platter that implements differential transmission lines.
Figure 15:
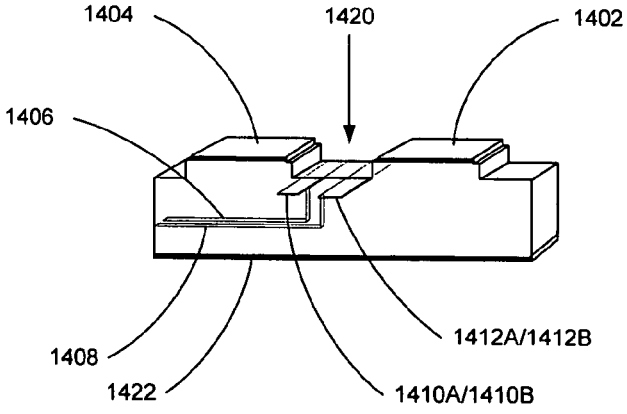
FIG. 15 is a partial cross-sectional view of a four layer PCB utilized in the construction of the PCB slip-ring platter of FIG. 14.

To accommodate higher frequencies or bandwidths for a given size of slip-ring, the resonant frequency of the slip-ring must generally be increased. One method of accomplishing this is to divide the feedline into multiple phasing lines and drive the slip-ring at multiple points. The effect is to place the distributed inductances of the slip-rings in parallel, which increases the resonant frequency proportional to the square-root of the inductance change. FIG. 14 shows a feed system 1400 that uses differential transmission lines and FIG. 15 shows a cross-section of a PCB slip-ring platter that incorporates the feed method. Two phasing lines and associated feedpoints are shown in the example, although three or more phasing lines can be used with appropriate allowance to matching the impedances.

The transmission line to rings 1402 and 1404 are connected to points 1401 and 1403, respectively, in both FIGS. 14 and 15. The crossfeed transmission lines 1406 and 1408 are designed to match the impedance of the feedline, 50 Ohms in this example. The parallel combination of phasing lines 1410A and 1410B and 1412A and 1412B are also designed to match the 50 Ohm impedance, or 100 Ohms individually. Each phasing line connection sees a parallel section of the rings 1402 and 1404, which, in this example, are designed for a 200 Ohm differential impedance. Other combinations are possible as well with appropriate adjustments to match impedances. Specifically, where N is the number of slip-ring feedpoints and Z is the input impedance, the phasing line impedance is N*Z and the ring impedance is 2*N*Z. Achieving higher impedance values is facilitated by the use of low dielectric constant materials. The phasing lines shown in FIG. 15 benefit from the proximity of the air in the negative barrier to achieve a lower dielectric coefficient and higher differential impedance.

The use of flexible circuitry 104 (see FIG. 1) in the construction of gradated impedance phasing line sections facilitates multi-point connections to rings 106A and 106B of PCB slip-ring platter 102. This method simplifies the construction of the PCB slip-ring as the phasing lines are external to the ring and are readily connected in parallel at the crossfeed transmission line. The gradated impedance matching sections allow the construction of slip-rings with smooth impedance profiles, which improves passband flatness and signal distortion due to impedance discontinuities. The use of gradated impedance phasing lines is generally a desirable feature when constructing broadband PCB slip-rings 100.

Slip-ring Mounting Method

Figure 16:
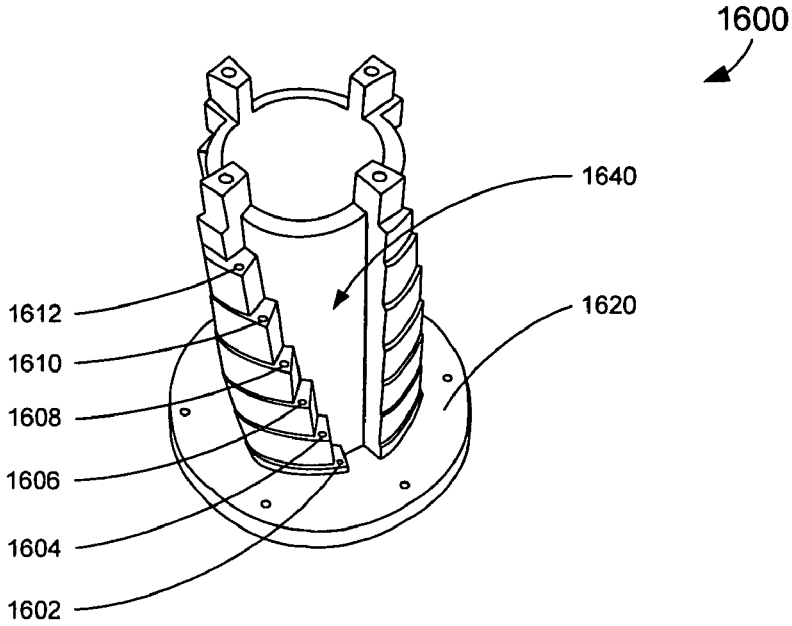
FIG. 16 is a perspective view of a rotary shaft for receiving a plurality of PCB slip-ring platters.
Figure 17:
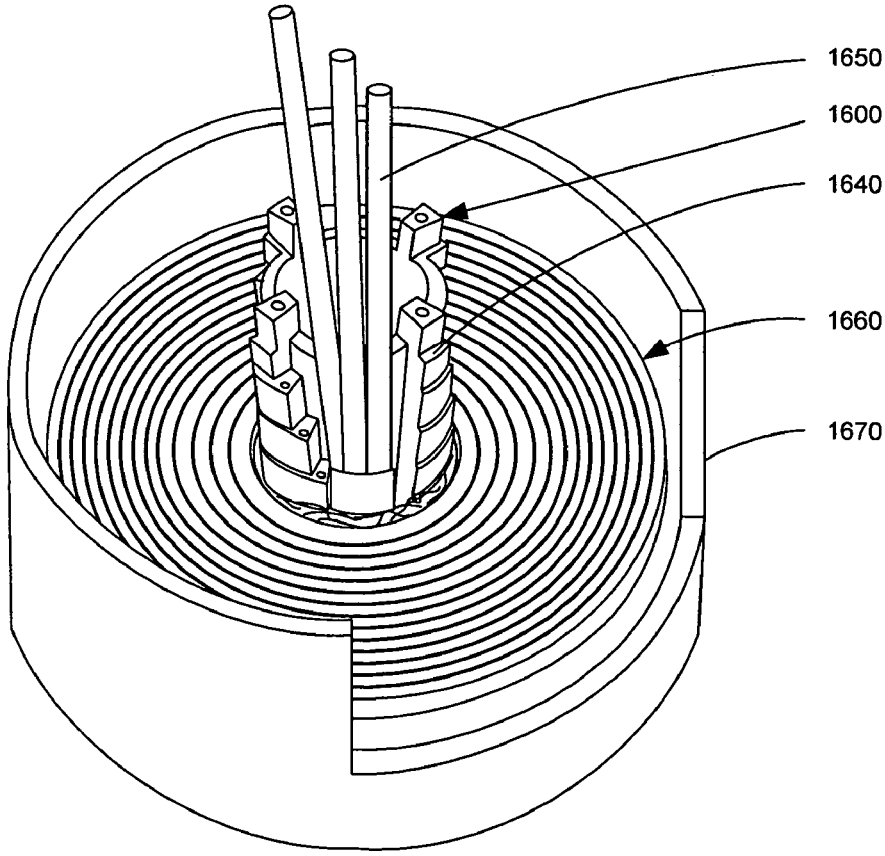
FIG. 17 is a perspective view of the rotary shaft of FIG. 16 including at least one slip-ring platter mounted thereto.

FIGS. 16 and 17 depict a rotary shaft 1600, for receiving a plurality of slip-ring platter assemblies 100, that is advantageously designed to facilitate construction of a slip-ring, while addressing three typical concerns encountered in the manufacturing of these devices. As designed, the shaft allows for control of axial positioning of the platters without tolerance stack-up, control of radial positioning of the platter slip-rings and wire and lead management. A significant difficulty when mounting slip-ring platters to a rotary shaft is avoiding tolerance stack-up that is inherent with many slip-ring mounting methods, e.g., those using spacers. Wire and lead management is also a perennial problem with the manufacture of most slip-rings as wire congestion increases with each additional platter. As is best shown in FIG. 16, the rotary shaft 1600 includes a number of steps that address the above-referenced issues.

The shaft 1600 may be a computerized numerical control (CNC) manufactured component with a series of concentric grooves machined to produce a helical arrangement of mounting lands/pads 1602–1612 for the platters 102 of the slip-ring system. The axial positioning of the grooves on the shaft 1600 are a function of the repeatability of the machining operation, thus one side of each slip-ring is located axially to within machining accuracy with no progressive tolerance stack-up. The opposite side of each platter 102 is positioned with only the ring thickness tolerance as an additional factor. The inside diameter of the grooves is sized to provide a radial positioning surface for the inside diameter of each platter. The helically arranged lands/pads 1602-1612 provide mounting features for each platter 102. The helical arrangement provides more wire way space as each platter 102 is installed. The shape of wire way 1640 provides a way for grouping wiring 1650 for cable management and electrical isolation purposes. As is shown in FIG. 17, the shaft 1600 may be advantageously located within a cavity 1660 of a form 1670 during the construction of the multiple platter slip-ring system.

In summary, a slip-ring system incorporating the features disclosed herein provides a high-frequency broadband slip-ring that can be characterized by the following points, although not necessarily simultaneously in a given implementation: the use of flat interdigitated contacts in conjunction with flat PCB slip-rings and transmission line techniques to achieve wide bandwidths; use of brush contact structures that include a central via coupled to a feedline, which provides performance advantages and allows for visual alignment verification between rings and brushes; PCB construction of differential transmission lines for multi-point feeding of slip-rings; the use of multiple flex tape phasing lines for multi-point feeding of slip-rings; the use of gradated impedance transmission line matching sections to affect impedance matching in PCB slip-rings in general and specifically in the above applications; the use of a negative barrier in PCB slip-ring platter design for its electrical isolation benefits as well as its high-frequency benefits attributable to a lower dielectric constant; the use of microstrip contacts, i.e., a flexible section of microstrip transmission line with embedded contacts to provide high-frequency performance advantages over more traditional approaches; and the use of a rotary shaft with steps in slip-ring construction for technical improvements in mechanical positioning and wire management.

Velocity Compensated Slip-ring

Figure 18:
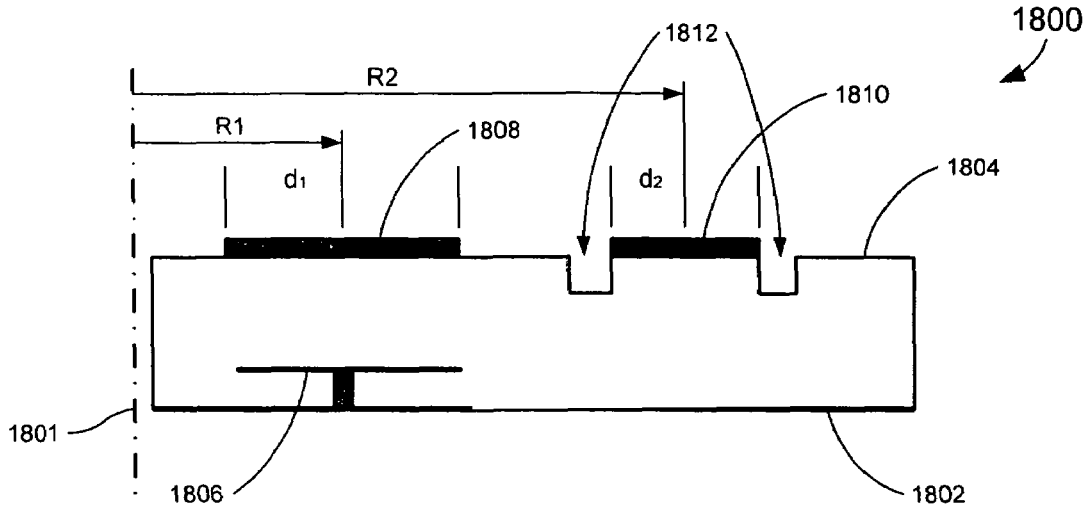
FIG. 18 is a cross-sectional view of a relevant portion of a slip-ring implementing a differential microstrip, constructed according to one embodiment of the present invention.

Transmitting differential signals across a platter-style slip-ring, with either conventional or printed circuit board (PCB) construction, may require addressing the problem of differing ring radii R1 and R2 of FIG. 18 of two conductors or more conductors that make up a transmission line. In a typical platter-type slip-ring, conductive rings with differing radii for each ring are implemented. Thus, the rings of a resulting ring pair have different physical circumferences and, thus, form a transmission line that is made up of two unequal path lengths. The differing physical lengths of the rings result in differing electrical lengths for the rings, with the result that differential signals carried by the rings become out of phase as they travel around the rings. A transmission line so constructed exhibits a host of electrical penalties, which include: degraded differential balance, increased radiation from the transmission line, increased vulnerability to common-mode signals, increased jitter and decreased digital data rate.

According to one aspect of the present invention, the limitations exhibited by slip-rings that utilize differing radii for the rings is addressed by the application of velocity compensation techniques. The velocity compensation techniques result in equalization of the electrical lengths of the rings, even though the rings have differing physical lengths. In this manner, signals propagating around the slip-ring remain in-phase with respect to angular position and do not exhibit phase delay that is inherent in prior art slip-rings.

With reference to FIG. 18 and according to the present invention, a number of techniques may be implemented to control and equalize the propagation velocity of a differential platter slip-ring 1800, which may rotate around a rotation axis 1801. For example, since a wider ring has a lower velocity of propagation than a narrower ring, a width of inner ring 1808 may be selected to be wider than a width of outer ring 1810. In this manner, the widths of the two rings of a differential pair are adjusted to achieve an equal electrical circumference (or equal time delay). The velocity of propagation of the outer ring 1810 may also be increased by forming grooves 1812 in a dielectric 1804 on either side of the outer ring 1810. The grooves 1812 effectively decrease an average dielectric constant and, thus, increase the velocity of propagation of a signal carried by the outer ring 1812. The grooves 1812 may be, for example, cut into the dielectric 1804 on one or both sides of the outer ring 1812. The size of the grooves 1812 may be adjusted to cause both the inner ring 1808 and the outer ring 1812 to have the same electrical circumference and time delay, despite having different physical circumferences.

The velocity of propagation of a ring may also be altered by changing the distance of a ring to a surrounding metal structure, such as the distance to ground plane 1802. For example, the velocity of propagation of a ring can be decreased by decreasing the distance to a ground plane. Alternatively, or in addition, an additional ground plane 1806 may be incorporated within the dielectric 1804 under the inner ring 1808. The physical dimensions of the additional ground plane 1806 and the distance between the ground plane 1806 and the inner ring 1808 may then be adjusted to achieve the same electrical length or time delay as the unaltered ring of the differential pair. The velocity of propagation of a ring may also be affected by controlling a thickness and surface finish of the rings. Although modification of thickness and surface finish typically have a relatively small effect on signal propagation velocity, altering these variables in combination with the other variables described above may allow a desired signal propagation velocity to be achieved. All of these techniques may implemented as stand-alone solutions or in combination with one or more of the other techniques to achieve a differential ring pair having rings with substantially the same electrical circumference (or time delay).

Figure 19:
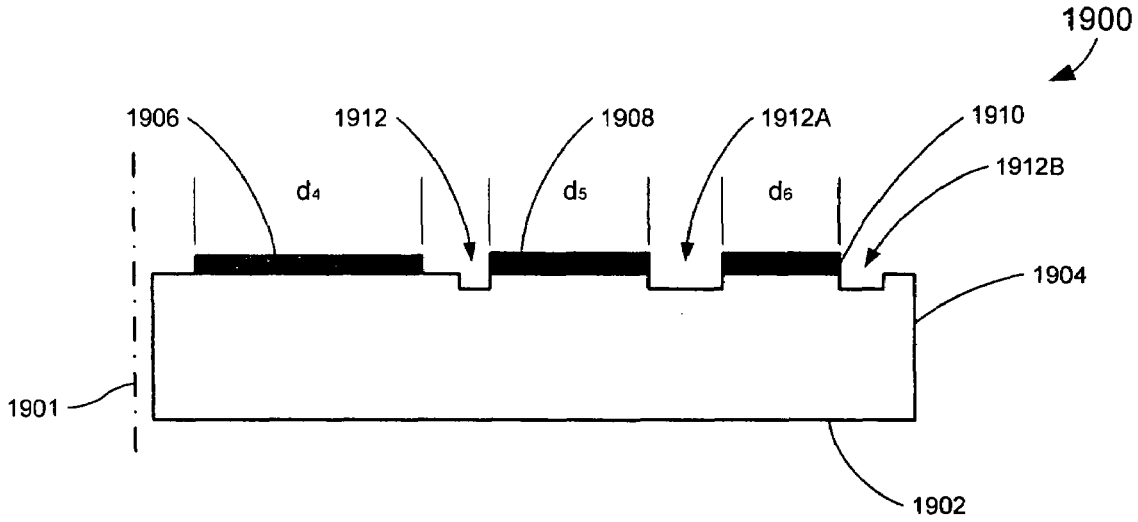
FIG. 19 is a cross-sectional view of a relevant portion of a slip-ring implementing a coplanar waveguide, constructed according to another embodiment of the present invention.

With reference to FIG. 19, the above described propagation velocity compensation techniques may also be used in slip-rings having one or more non-differential transmission lines, such as coplanar waveguide 1900, which may rotate about a rotation axis 1901. Any combination of the techniques describe above may be used to adjust a propagation velocity of inner ring 1906, middle ring 1908 and outer ring 1910 to achieve substantially equal electrical lengths for the rings 1906, 1908 and 1910, which are spaced from ground plane 1902. In one embodiment, three different ring widths may be implemented to progressively increase the velocity of propagation with increasing radius of the ring. In situations where the difference in radii is too large to allow for full compensation by altering the ring widths, the velocity of propagation of the rings 1908 and 1910 can also be increased by forming grooves 1912, 1912A and 1912B into dielectric 1904. Furthermore, a secondary ground plane ring (such as shown in FIG. 18) may be included under the inner ring 1906 to slow the velocity of propagation of a signal carried on the ring 1906.

In the various cases, the goal is to create a geometry that equalizes the electrical lengths of the concentric rings, by altering the ring width, thickness or surface finish, and/or by locally modifying the effective dielectric constant of the surrounding dielectric media and/or by adding a secondary ground plane beneath an appropriate ring.

Incorporating Passive and Active Components on PCB Slip-ring Transmission Lines

Signal integrity concerns, when implementing slip-rings, can require the use of passive components to terminate transmission lines of the slip-rings, in order to control reflections from impedance discontinuities. PCB slip-ring construction techniques can also be used to incorporate these terminations into the construction of the PCB by various techniques, e.g., by implementing surface-mount components for LCR networks, embedded passive (LCR) components within or on the PC board S/R and/or strip-line techniques to create LCR networks using the PCB traces.

Figure 20:
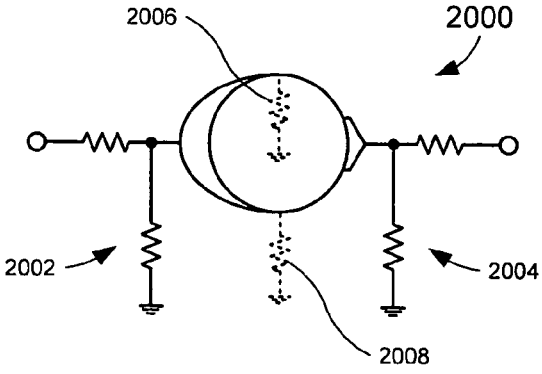
FIG. 20 is an electrical schematic of a single-ended slip-ring, constructed according to one embodiment of the present invention.
Figure 21:
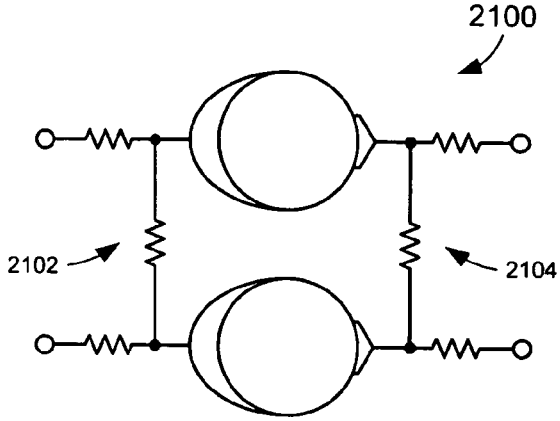
FIG. 21 is an electrical schematic of a differential slip-ring, constructed according to another embodiment of the present invention.

A termination technique for a single-ended slip-ring may include a series-shunt connection of resistor networks 2002 and 2004, as is illustrated in FIG. 20, for a single-ended slip-ring 2000. A termination technique for a differential slip-ring may include a series-shunt connection of resistor networks 2101 and 2104, as is illustrated in FIG. 21, for a differential slip-ring 2100. More complex networks consisting of inductive, capacitive and/or resistive (LCR) elements can be used as needed to perform necessary transformations of impedance, voltage or current. The use of active electronic devices can also provide such transformations, in addition to signal conditioning, conversion and/or recovery. The incorporation of electronic components onto or into the slip-ring transmission line, as is described above, is advantageous for maintaining signal integrity.

Figure 22:
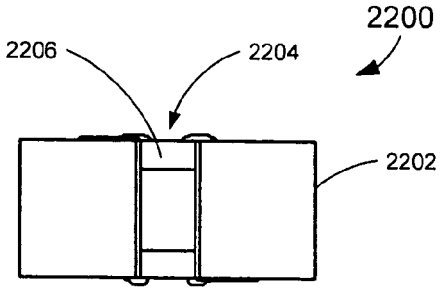
FIG. 22 is a cross-sectional view of a relevant portion of a printed circuit board (PCB) slip-ring, including a surface mount technology (SMT) component mounted in a via of the PCB.

Surface Mount Technology (SMT) can be used to mount SMT electronic components directly on or thru slip-ring PCBs, implemented by using surface pads for mounting the components on the slip-ring or contact PCB. With reference to FIG. 22, shunt elements 2206 may be installed inside a via 2204 of a PCB 2202 of slip-ring 2200. In this case, the elements 2206 are soldered at each end to achieve connection without the stray reactances that may be inherent in using other via and pad constructions. These SMT techniques can be used for the slip-ring and contact PCBs, as well as flex tape transmission lines and intermediate connector boards.

Figure 23:
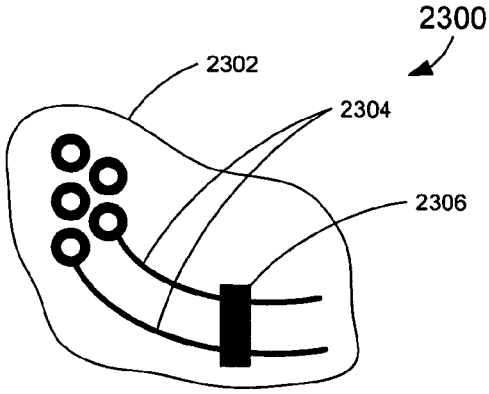
FIG. 23 is a top view of a relevant portion of a slip-ring having an embedded resistor coupled across two signal lines of the slip-ring, constructed according to another embodiment of the present invention.

With reference to FIG. 23, embedded passive components 2306 can be incorporated directly into a PCB 2302 of slip-ring 2300 or into a contact (brush block) PCB. This may be achieved by applying resistive and/or capacitive elements into appropriate intermediate layers of the PCB stack, using thin-film or other technologies. The ability to apply such components at key places in a slip-ring PCB layout is advantageous for signal integrity, from the standpoint of controlling impedance and managing reflections. With reference again to FIG. 20, resistors 2006 and 2008, shown in dotted form, may be effectively incorporated as embedded passive components. With reference again to FIG. 23, the component 2306 may be a film resistor that is deposited directly across copper traces 2304 of a layer of the PCB 2302. Furthermore, transmission line networks for microwave frequencies can be implemented using PCB strip-lines and microstrips (creating capacitors and inductors using printed circuit traces), allowing the components to be incorporated directly into the slip-ring or contact PCB as part of the lay-up without using discrete components.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

What is claimed is:

1. A contacting ring system, comprising:

a first dielectric material with a first side and a second side;

a plurality of concentric spaced conductive rings located on the first side of the first dielectric material, wherein the conductive rings include an inner ring an outer ring;

a first ground plane located on the second side of the first of the inner ring is greater than a width of the outer ring;

a second ground plane formed in the first dielectric material between the inner ring and the first ground plane, wherein the second ground plane causes a decrease in a signal propagation velocity of the inner ring; and wherein the widths of the inner and outer rings are selected to substantially equalize electrical lengths of the inner and outer rings.

2. The system of claim 1, wherein grooves are formed in the first dielectric material on at least one side of the outer ring to cause an increase in a signal propagation velocity of the outer ring.

3. The system of claim 1, wherein the inner and outer rings provide a differential pair of a transmission line.

4. The system of claim 1, wherein thicknesses of the inner and outer rings are different.

5. The system of claim 4, wherein surface finishes of the inner and outer rings are different.

6. The system of claim 1, wherein the inner and outer rings provide a non-differential transmission line.

7. The system of claim 6, wherein the non-differential transmission line is a coplanar waveguide.

8. The system of claim 1, further comprising:

a plurality of terminators located to reduce reflections attribute to impedance discontinuities.

9. The system of claim 8, wherein the terminators are positioned within vias.

10. The system of claim 8, wherein the terminators are at least one of surface mount components, embedded passive components or components created using strip-line techniques.

11. The system of claim 10, wherein the terminators are embedded passive components. and the embedded passive components are thin-film components.

12. A contacting ring system, comprising:

a first dielectric material with a first side and a second side;

a plurality of concentric spaced conductive rings located on the first side of the first dielectric material, wherein the conductive rings include an inner ring and an outer ring;

a first ground plane located on the second side of the firs are formed in the first dielectric material on at least one side of the outer ring to cause an increase in a signal propagation velocity of the outer ring; and a second ground plane formed in the first dielectric material between the inner ring and first ground plane, wherein the second ground plane causes a decrease in a signal propagation velocity of the inner ring.

13. The system of claim 12, further comprising:

a plurality of terminators located to reduce reflections attributable to impedance discontinuities.

14. The system of claim 12, wherein the terminators are at least one of surface mount components, embedded passive components or components created using strip-line techniques.

15. The system of claim 12, wherein a width of the inner ring is greater than a width of the outer ring, and wherein the widths of the inner and outer rings are selected to substantially equalize electrical lengths of the inner and outer rings.

16. The system of claim 12, wherein thicknesses of the inner and outer rings are different, and wherein surface finishes of the inner and outer rings are different.

* * * * *